US008737863B2

(12) United States Patent
Cho

(10) Patent No.: US 8,737,863 B2
(45) Date of Patent: May 27, 2014

(54) DEVELOPING CARTRIDGE AND IMAGE FORMING APPARATUS HAVING THE SAME

(75) Inventor: Young Kee Cho, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 278 days.

(21) Appl. No.: 13/206,685

(22) Filed: Aug. 10, 2011

(65) Prior Publication Data

US 2012/0039622 A1 Feb. 16, 2012

(30) Foreign Application Priority Data

Aug. 12, 2010 (KR) ..... 10-2010-0077634

(51) Int. Cl.
*G03G 15/00* (2006.01)

(52) U.S. Cl.
USPC ..... 399/90; 399/111; 399/12; 399/27; 399/109

(58) Field of Classification Search
USPC ..... 399/111, 90, 12, 27, 109
See application file for complete search history.

(56) References Cited

U.S. PATENT DOCUMENTS

2007/0230999 A1* 10/2007 Shimomura ..... 399/113

FOREIGN PATENT DOCUMENTS

| | | |
|---|---|---|
| JP | 11-045042 | 2/1999 |
| JP | 11-133839 | 5/1999 |

* cited by examiner

*Primary Examiner* — Walter L Lindsay, Jr.
*Assistant Examiner* — Roy Y Yi
(74) *Attorney, Agent, or Firm* — Stanzione & Kim, LLP

(57) ABSTRACT

A developing cartridge having a memory unit and an image forming apparatus in which the developing cartridge is separably installed. Once the developing cartridge is installed in the image forming apparatus, the memory unit of the developing cartridge is arranged to face a recording medium delivery path. The memory unit is connectable to a connection unit of a board placed in a lower region of the image forming apparatus.

29 Claims, 11 Drawing Sheets

DEVELOPING CARTRIDGE AND IMAGE FORMING APPARATUS HAVING THE SAME

CROSS REFERENCE TO RELATED APPLICATIONS

This application claims the benefit of priority under 35 U.S.C. §119 to Korean Patent Application No. 2010-0077634, filed on Aug. 12, 2010 in the Korean Intellectual Property Office, the disclosure of which is incorporated herein in its entirety by reference.

BACKGROUND

1. Field of the Invention

The present general inventive concept relates to a developing cartridge including a memory unit and an image forming apparatus having the same.

2. Description of the Related Art

Generally, image forming apparatuses include a variety of appliances, such as copiers, printers, facsimiles, and Multi Function Peripherals (MFPs), which output image data. Here, MFPs may have functions including copying, printing, scanning, facsimile sending/reception, E-mail transmission, and file transmission.

A developing cartridge in which developer is stored may be separably mounted in a body of an image forming apparatus.

The developing cartridge may need to be refilled periodically because the developer is consumed whenever image data is output to a medium.

Such a developing cartridge may include a memory unit to store information related to the developing cartridge including manufacturer, developer color, developer quantity, remaining developer, etc.

The memory unit having a plurality of terminals is exposed from a housing surface of the developing cartridge.

The exposed memory unit is connected to contacts of an auxiliary board provided in the body of the image forming apparatus by means of the plurality of terminals.

The contacts of the auxiliary board are connected to a control board of the image forming apparatus by means of a harness for transmission of electricity or signals.

The image forming apparatus may need an interior installation space corresponding to the exposed position of the memory unit, the harness between the control board and the contacts of the auxiliary board, or the installation position of the control board. The size of the image forming apparatus (length×width×height) is affected by the installation space.

SUMMARY

Additional aspects and utilities of the present general inventive concept will be set forth in part in the description which follows and, in part, will be obvious from the description, or may be learned by practice of the present general inventive concept.

The present general inventive concept provides a developing cartridge, separably installed in an image forming apparatus having a recording medium delivery path, including a photoconductive medium on which an electrostatic latent image corresponding to an irradiated laser beam is formed, a charging unit to charge the photoconductive medium, a developer delivery member to supply developer to the photoconductive medium to enable formation of a visible image corresponding to the electrostatic latent image, a cleaning unit to remove developer remaining on the photoconductive medium after the visible image formed on the photoconductive medium is transferred to a recording medium, and a memory unit to store developing cartridge information and having a plurality of terminals to come into contact with a connection unit of a board placed in a lower region of the image forming apparatus when the developing cartridge is installed into the image forming apparatus.

The developer delivery member may include at least one rotating shaft, and the memory unit may come into contact with the connection unit below the rotating shaft when the developing cartridge is installed into the image forming apparatus.

The memory unit may be arranged at a rear end of the developing cartridge with respect to an installation direction of the developing cartridge.

The plurality of terminals of the memory unit may be arranged to face the recording medium delivery path when the developing cartridge is installed into the image forming apparatus.

The memory unit may be arranged outside of a region defined by the width of the recording medium that is delivered along the recording medium delivery path.

The developing cartridge may further include a housing to rotatably support the photoconductive medium. The housing may include an opening perforated in an axial direction of the photoconductive medium to allow a partial surface of the photoconductive medium to be exposed to the outside of the housing, and the plurality of terminals of the memory unit may be arranged at a lateral side of the opening with respect to an installation direction of the developing cartridge.

The plurality of terminals may be arranged in a line or in a zigzag pattern along the recording medium delivery path.

At least one of the plurality of terminals may have a length different from those of the other terminals.

Features and/or utilities of the present general inventive concept may also be realized by providing an image forming apparatus to form an image on a recording medium, the image forming apparatus including a light scanning unit, a body having a guide to enable installation of a developing cartridge, a recording medium delivery unit to deliver the recording medium along a recording medium delivery path defined in the body, the developing cartridge separably installed in the body using the guide and including a photoconductive medium on which an electrostatic latent image corresponding to a laser beam irradiated from the light scanning unit is formed, a charging unit to charge the photoconductive medium, a developer delivery member to supply developer to the photoconductive medium to enable formation of a visible image corresponding to the electrostatic latent image, a cleaning unit to remove developer remaining on the photoconductive medium after the visible image formed on the photoconductive medium is transferred to the recording medium, and a memory unit to store developing cartridge information and having a plurality of terminals facing the recording medium delivery path, and a board including a controller and a connection unit to come into contact with the plurality of terminals of the memory unit, the board being placed in a lower region of the body to allow the connection unit to be located below the plurality of terminals.

The developer delivery member may include at least one rotating shaft, and the connection unit may come into contact with the plurality of terminals below the rotating shaft.

The connection unit may come into contact with the plurality of terminals outside of a region defined by the width of the recording medium that is delivered along the recording medium delivery path.

The connection unit may include connection members protruding upward to come into contact with the plurality of terminals, and support members connected to the board and to elastically support corresponding ones of the connection members.

The connection unit may include connection members connected to the board and protruding upward to come into elastic contact with the plurality of terminals.

The connection members may have a contact angle of about 70 to 110 degrees with a surface of the terminal.

The connection unit may be arranged at an edge of the board to come into contact with the plurality of terminals.

The connection members may be arranged in a line or in a zigzag pattern along the recording medium delivery path.

The controller may read the stored developing cartridge information by use of at least one of the plurality of terminals connected to the connection unit upon installation of the developing cartridge.

The controller of the board may confirm whether or not the developing cartridge is mounted by use of at least one of the plurality of terminals coming into contact with the connection unit of the board when the developing cartridge is mounted into the body.

Features and/or utilities of the present general inventive concept may also be realized by providing a developer cartridge, separably installed in an image forming apparatus having a recording medium delivery path, the developer cartridge including a housing to store developer, the housing having a sidewall arranged close to the recording medium delivery path when installed into the image forming apparatus, at least one developer delivery member rotatably supported in the housing to deliver the developer, and a memory unit serving to store developer cartridge information and having a plurality of terminals exposed to the outside of the housing through the sidewall so as to come into contact with a connection unit of a board placed below the recording medium delivery path when the developer cartridge is installed into the image forming apparatus.

The plurality of terminals of the memory unit may be arranged to face the recording medium delivery path when the developer cartridge is installed into the image forming apparatus.

Features and/or utilities of the present general inventive concept may also be realized by providing an image forming apparatus to form an image on a recording medium, the image forming apparatus including a light scanning unit, a body having a guide to enable separation/installation of a developer cartridge, a recording medium delivery unit to deliver the recording medium along a recording medium delivery path defined in the body, a photoconductive medium on which an electrostatic latent image corresponding to a laser beam irradiated from the light scanning unit is formed, the developer cartridge separably installed in the body using the guide and including a housing to store developer, the housing having a sidewall arranged close to the recording medium delivery path when mounted into the image forming apparatus, at least one developer delivery member rotatably supported in the housing to deliver the developer to the photoconductive medium, and a memory unit to store developer cartridge information and having a plurality of terminals exposed to the outside of the housing through the sidewall, and a board including a controller and a connection unit to come into contact with the plurality of terminals of the developer cartridge, the board being placed below the recording medium delivery path to allow the connection unit to come into contact with the plurality of terminals from below when the developer cartridge is mounted into the body using the guide.

The plurality of terminals of the memory unit may be arranged to face the recording medium delivery path when the developer cartridge is mounted into the image forming apparatus, and the connection unit may come into contact with the plurality of terminals facing the recording medium delivery path.

Features and/or utilities of the present general inventive concept may also be realized by providing a developing cartridge to be installed in an image forming apparatus, including a housing, a photoconductive medium disposed in the housing to form an image on a recording medium moving along a feeding direction, and a memory unit storing developer cartridge information and disposed on a portion of the housing at a downstream of the feeding direction.

The photoconductive medium may rotate in a rotation direction and the memory unit may be disposed on the portion of the housing corresponding to the rotation direction and the feeding direction.

The housing may include a first portion in which a charging unit is disposed, and a second portion in which a developer delivery member is disposed, wherein the memory unit may be disposed on the first portion of the housing.

The memory unit may be disposed on a bottom portion of the housing.

The memory unit may include a plurality of terminals which form a part of an exterior surface of the developing cartridge.

BRIEF DESCRIPTION OF THE DRAWINGS

The above and/or other aspects of the present general inventive concept will become apparent and more readily appreciated from the following description of the exemplary embodiments, taken in conjunction with the accompanying drawings, in which.

DETAILED DESCRIPTION OF THE EMBODIMENTS

Figure 1:
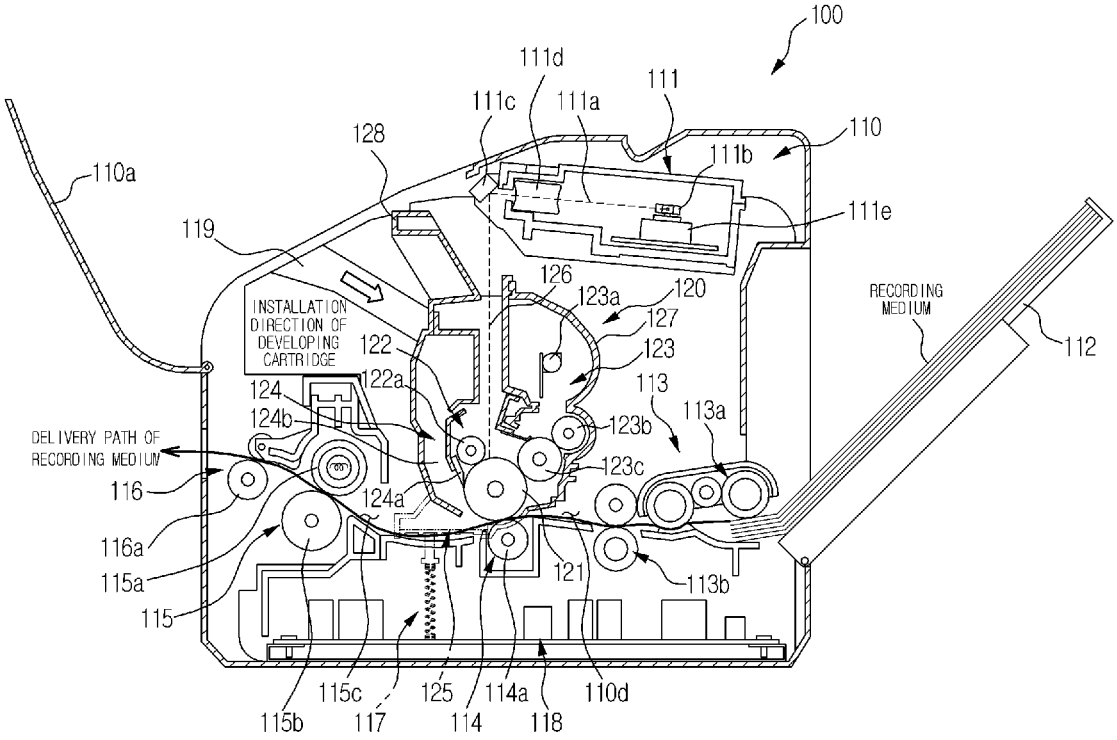
FIG. 1 is a sectional view illustrating an image forming apparatus in which a developing cartridge is installed according to an exemplary embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a sectional view illustrating an image forming apparatus 100 in which a developing cartridge is installed according to an exemplary embodiment of the present general inventive concept.

Referring to FIG. 1, the image forming apparatus 100 includes a body 110, a light scanning unit 111, a recording medium supply tray 112, a recording medium supply unit 113, a transfer unit 114, a fusing unit 115, a recording medium discharge unit 116, a connection unit 117, a board 118, a guide 119, and a developing cartridge 120.

The developing cartridge 120 includes a photoconductive medium 121, a charging unit 122, a developing unit 123, a cleaning unit 124, a memory unit 125, an optical path 126, a housing 127, and a handle 128.

The developing cartridge 120 is separably mounted in the body 110 of the image forming apparatus 100. The body 110 is provided with the guide 119 to guide the developing cartridge 120 upon installation/separation of the developing cartridge 120.

In response to signals transmitted from external devices 10 and 20 (see FIG. 9) or output signals of an operating unit 160 (see FIG. 9) of the image forming apparatus 100, the charging unit 122 electrically charges the photoconductive medium 121 having at least one photoconductive layer, and then, the light scanning unit 111 forms an electrostatic latent image on the photoconductive medium 121 by irradiating a laser beam 111*a* according to image information of an output object. As a developer delivery member supplies developer to the photoconductive medium 121 on which the electrostatic latent image has been formed, a visible image is formed on the photoconductive medium 121.

The recording medium supply unit 113 supplies recording media stacked on the recording medium supply tray 112 to a recording medium delivery path 110*d* one sheet at a time.

In the exemplary embodiment, the recording medium supply unit 113 may constitute a recording medium delivery unit to deliver the recording media to the recording medium delivery path 110*d*.

The transfer unit 114 transfers the visible image formed on the photoconductive medium 121 to a recording medium, and the fusing unit 115 fuses the transferred image to the recording medium using heat and pressure. Also, the recording medium discharge unit 116 discharges the resulting recording medium from the image forming apparatus 100.

If the developer remains on the photoconductive medium 121 after the visible image of the photoconductive medium 121 is transferred to the recording medium, the cleaning unit 124 removes the developer from the photoconductive medium 121, and the removed developer is collected in a waste developer storage container 124*b*.

The above described image forming operation is repeated in response to additional output signals.

Figure 9:
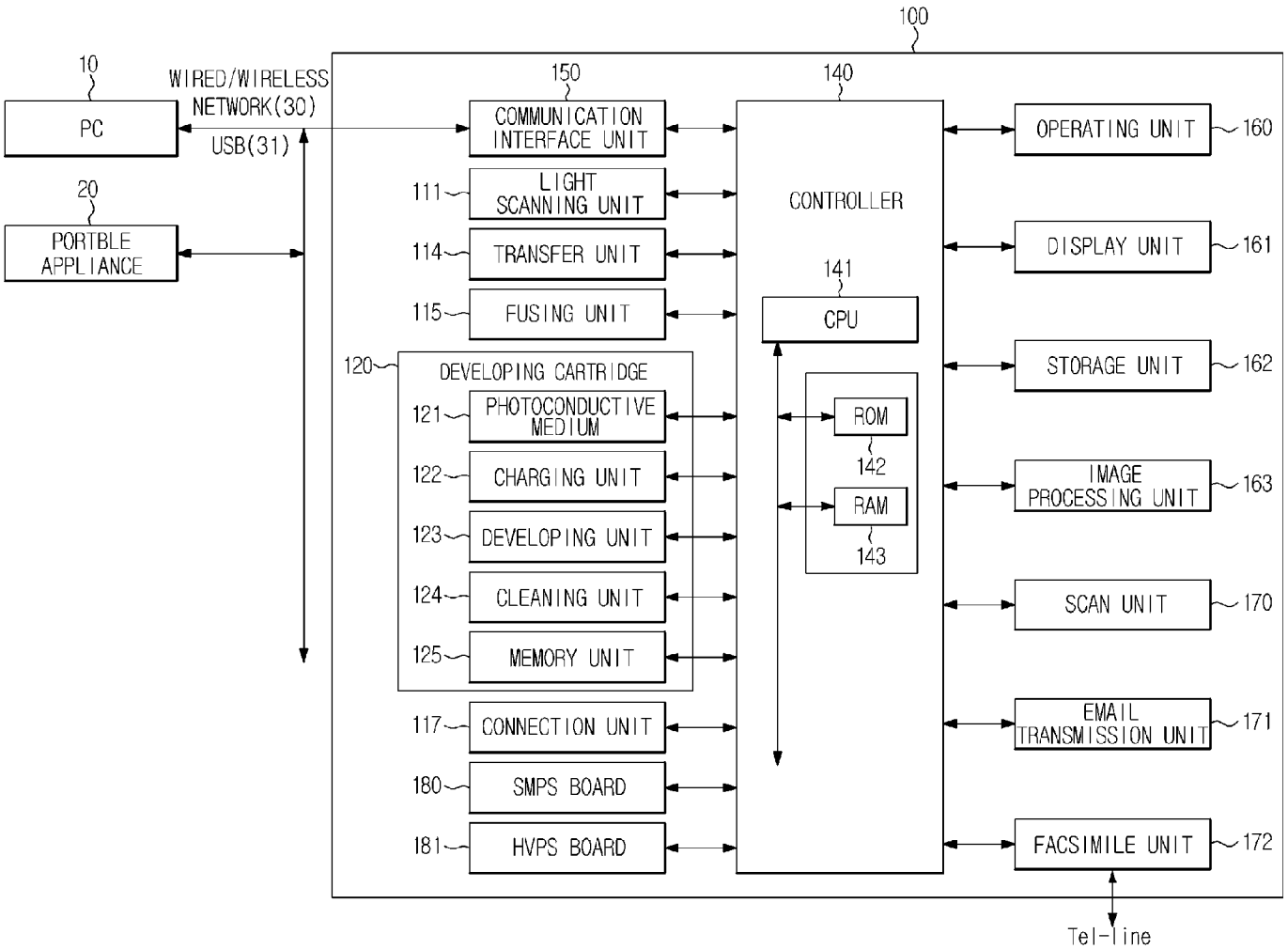
FIG. 9 is a block diagram illustrating the image forming apparatus according to an exemplary embodiment of the present general inventive concept.

Referring to FIG. 9, the external devices 10 and 20 may be any one of a computer connected by a wired/wireless network 30 or Universal Serial Bus (USB) 31, a portable appliance including a cellular phone or a digital camera, and a facsimile (not shown) connected by a cable.

The light scanning unit 111 includes a laser diode (not shown) to irradiate the laser beam 111*a* according to image information of an output object, a polygonal mirror 111*b*, at least one reflecting mirror 111*c*, at least one lens 111*d*, and a drive motor 111*e*.

The light scanning unit 111 may include the laser diode (not shown) and the polygonal mirror 111*b*.

The light scanning unit 111 may include a Light Emitting Diode (LED) array (not shown) in which a plurality of LEDs are arranged to form an electrostatic latent image on the photoconductive medium 121, and a lens unit (not shown) corresponding to the LEDs.

The light scanning unit 111 may include a Micro Electro-Mechanical System (MEMS).

The developing cartridge 120 includes the photoconductive medium 121, the charging unit 122, the developing unit 123, the cleaning unit 124, the optical path 126, and the memory unit 125.

The charging unit 122 may include a charging roller 122*a*. If voltage is applied to the charging roller 122*a*, the charging roller 122*a* charges the photoconductive medium 121 having the photoconductive layer with a uniform potential. The light scanning unit 111 forms an electrostatic latent image by irradiating the laser beam 111*a* to the charged photoconductive medium 121.

At least one developer, delivery member, such as an agitator 123*a*, a supply roller 123*b*, or a developing roller 123*c*, has a rotating shaft. The developer delivery member delivers developer stored in the developing cartridge 120 to the photoconductive medium 121 to enable a visible image corresponding to the electrostatic latent image to be formed on the photoconductive medium 121.

The agitator 123*a* of the developing cartridge 120 may include an auger.

The agitator 123*a* agitates the stored developer to deliver it to the supply roller 123*b*, the supply roller 123*b* supplies the delivered developer to the developing roller 123*c*, and the developing roller 123*c* delivers the developer from the supply roller 123*b* to the photoconductive medium 121.

The developer delivery member may include the developing unit 123.

The housing 127 rotatably supports the photoconductive medium 121 and the developer delivery member. The housing 127 may have a first opening 1278 (see FIG. 2) facing a lower surface of the reflecting mirror 111*c* of the light scanning unit 111, through which the irradiated laser beam 111*a* is introduced, the first opening being selectively intercepted by an optical path shutter (not shown), and a second opening 127*b* (see FIG. 3) facing the transfer unit 114, the second opening being selectively open via opening/closing operations of a photoconductive medium shutter (not shown).

The housing 127 may further have an end surface 127*c* (see FIG. 2), a third opening 127*d* (see FIG. 3), through which a string of gears 129 adapted to receive power from the image forming apparatus 100 is exposed, and at least one protrusion 127*e* (see FIG. 2) protruding from the end surface 127*c* to guide installation/separation of the developing cartridge 120.

The optical path 126 is defined in the housing 127 of the developing cartridge 120 to allow the laser beam 1113 irradiated from the light scanning unit 111 to reach the photoconductive medium 121.

If the developing cartridge 120 is installed in the image forming apparatus 100, the optical path shutter (not shown) is opened to allow passage of the irradiated laser beam 111*a*. Then, if the developing cartridge 120 is separated from the image forming apparatus 100, the optical path shutter (not shown) is closed.

If the developing cartridge has no optical path shutter (not shown), the first opening 127*a* (see FIG. 2) is always open regardless of installation/separation of the image forming apparatus 100.

The optical path shutter (not shown) is located near a fixed end 128*b* (see FIG. 2) of the handle 128 for installation/separation of the developing cartridge 120. The optical path shutter (not shown) is located between the center of a rotating shaft of the charging roller 122*a* and the center of a rotating shaft of the supply roller 123*b*.

If the developing cartridge 120 is installed in the image forming apparatus 100, the photoconductive medium shutter (not shown) is opened to allow the photoconductive medium 121 to come into contact with the transfer roller 114*a*. Then, if the developing cartridge 120 is separated from the image forming apparatus 100, the photoconductive medium shutter (not shown) is closed to cover the photoconductive medium 121.

If the developing cartridge has no photoconductive medium shutter (not shown), the photoconductive medium 121 may always be exposed through the second opening 127*b* (see FIG. 2) regardless of installation/separation of the image forming apparatus 100.

The photoconductive medium shutter (not shown) begins to be opened before the developing cartridge 120 is completely installed, and also, begins to be closed before the developing cartridge 120 is separated from the guide 119 of the image forming apparatus 100.

The optical path 126, which is defined in the developing cartridge 120 to allow the laser beam 111*a* reflected by the reflecting mirror 111*c* of the light scanning unit 111 to reach the photoconductive medium 121, may have an angle of 5~10 degrees with respect to a vertical direction. The angle of 5~10 degrees may prevent the laser beam 1118 irradiated to the photoconductive medium 121 from interfering with a beam reflected from a surface of the photoconductive medium 121.

Figure 2:
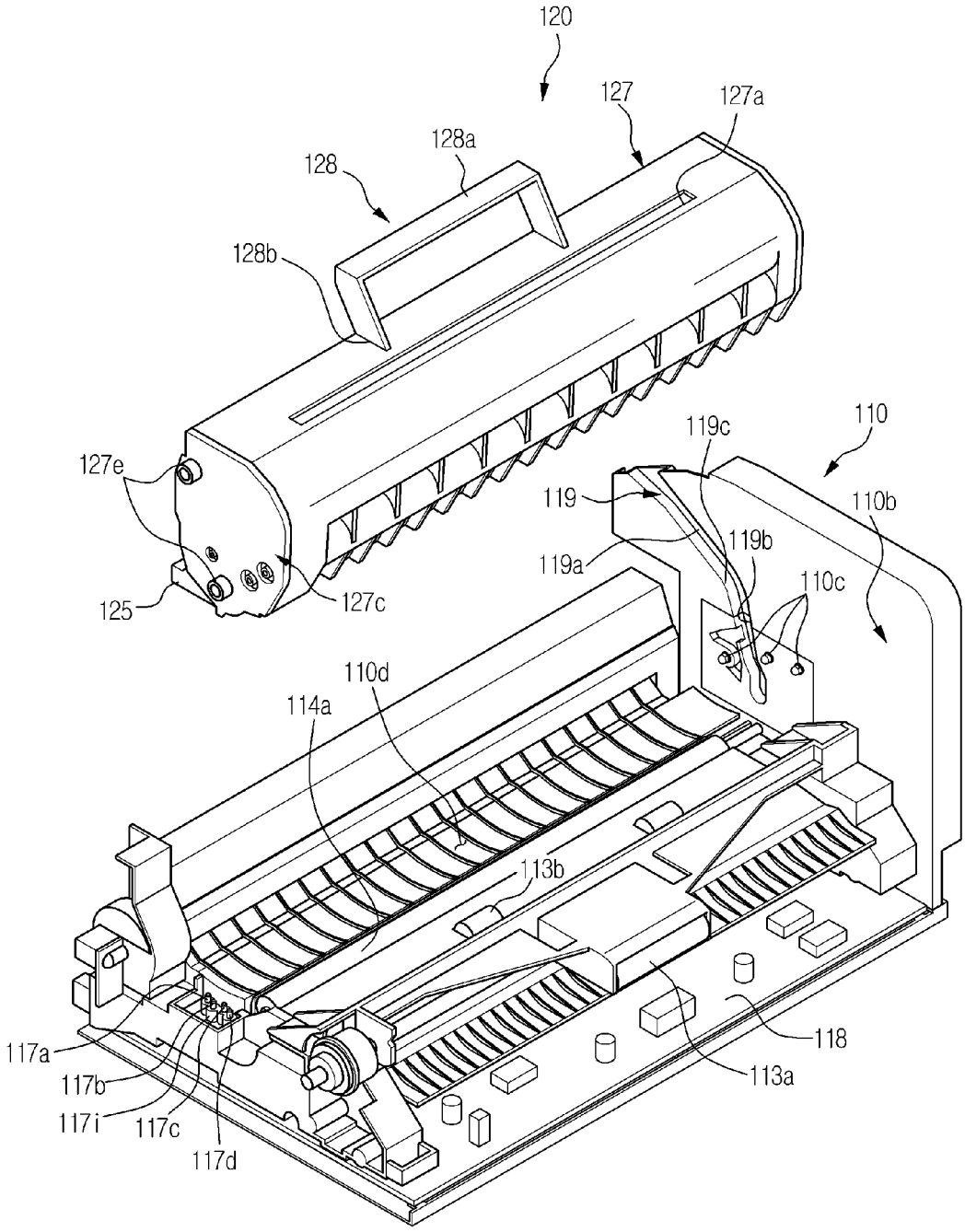
FIG. 2 is a perspective view schematically illustrating a state just prior to installing the developing cartridge into the image forming apparatus according an exemplary embodiment of the present general inventive concept.

The handle 128 protrudes from the developing cartridge 120 and has one free end 128*a* (see FIG. 2) and the other fixed end 128*b* (see FIG. 2).

If developer remains on the photoconductive medium 121 after the transfer unit 114 including the transfer roller 114*a* transfers the visible image on the photoconductive medium 121 to the recording medium, the cleaning unit 124 including a cleaning blade 124*a* removes the developer. The removed waste developer is stored in the waste developer storage container 124*b*.

The recording medium delivery path 110*d* serves to allow the recording medium, picked up from the recording medium supply tray 112, to move inside the image forming apparatus 100. The recording medium delivery path 110*d* has a greater width than the width of the largest recording medium that can be utilized by the image forming apparatus 100.

The recording medium delivery unit delivers the recording medium to the recording medium delivery path 110*d*.

The recording medium supply unit 113 may include a pickup roller 113*a* to pick up the recording medium from the recording medium supply tray 112, and at least one feeding roller 113*b* to supply the picked-up recording medium to the photoconductive medium 121.

A recording medium supply tray (not shown) including a knock-up plate (not shown) may be also be used to supply a recording medium according to the kind of the image forming apparatus 100. Alternatively, the image forming apparatus 100 may be provided with a plurality of recording medium supply cassettes.

The fusing unit 115 fuses the visible image transferred to the recording medium using heat and pressure.

The fusing unit 115 includes at least one heat roller 115*a* containing a heat source therein and at least one pressure roller 115*b*.

The fusing unit 115 may alternatively include a heat belt inside which a heat source is arranged.

The recording medium discharge unit 116 may include at least one recording medium discharge roller 116*a* to discharge the recording medium, having passed through the fusing unit 115, to the outside of the image forming apparatus 100.

The image forming apparatus 100 may have a double-sided printing function and the recording medium discharge roller 116*a* may supply the recording medium, on one surface of which an image has been formed, to a double-sided printing path (not shown) to enable image formation on the other surface of the recording medium.

Figure 3:
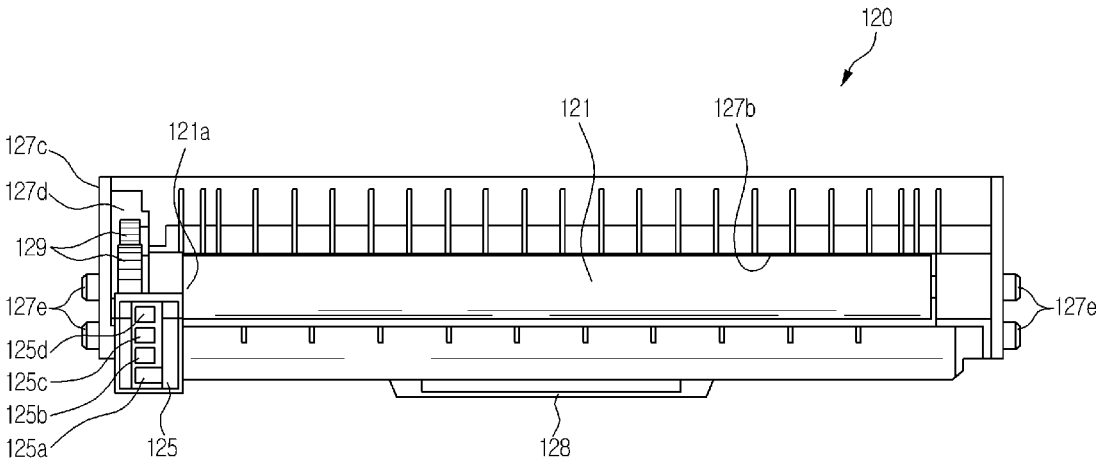
FIG. 3 is a bottom view of the developing cartridge according to an exemplary embodiment of the present general inventive concept.

The developing cartridge 120 includes the memory unit 125 having developing cartridge information. Referring to FIG. 3, the memory unit 125 may include a plurality of terminals, i.e. a ground terminal 125*a*, a cluck terminal 125*b*, a data transmission terminal 125*c*, and a voltage application terminal 125*d*.

The plurality of terminals 125*a* to 125*d* may come into contact with the connection unit 117 of the board 118 provided in a lower region of the image forming apparatus 100.

The plurality of terminals 125*a* to 125*d* of the memory unit 125 are arranged below the at least one developer delivery member, which is supported by the housing 127 and has a rotating shaft.

The connection unit 117 protrudes upward from the board 118 toward the light scanning unit 111. The plurality of terminals 125*a* to 125*d* of the memory unit 125 may come into contact with the connection unit 117 when the developing cartridge 120 is mounted into the image forming apparatus 100.

The plurality of terminals 125*a* to 125*d* of the memory unit 125 are arranged to face the recording medium delivery path 110*d*.

The plurality of terminals 125*a* to 125*d* of the memory unit 125 are arranged at a rear end of the developing cartridge 120 with respect to an installation direction of the developing cartridge 120. The plurality of terminals 125*a* to 125*d* of the memory unit 125 may be arranged between an entrance 115*c* of the fusing unit 115 and a vertical line connecting the center of a rotating shaft of the photoconductive medium 121 and the board 118 to each other. The terminals 125*a* to 125*d* and/or the connection unit 117 may be disposed on a path between the photoconductive drum 121 and the fusing unit 115.

The plurality of terminals 125*a* to 125*d* may be located close to the recording medium delivery path 110*d*.

To prevent the connection unit 117 of the board 118 from interfering with the delivery of the recording medium, the connection unit 117 may be located to come into contact with the plurality of terminals 125*a* to 125*d* outside of a region defined by the width of the largest recording medium that can be utilized by the image forming apparatus 100.

The second opening 127*b* of the housing 127 is perforated in an axial direction of the photoconductive medium 121 to expose a partial surface of the photoconductive medium 121 to the outside of the housing 127. The plurality of terminals 125*a* to 125*d* may be located at a lateral side of the second opening 127*b* with respect to the installation direction of the developing cartridge 120, and more particularly, may be located closer to the fusing unit 115 than a center line of the second opening 127*b*.

The plurality of terminals 125*a* to 125*d* may be aligned in a line or in a zigzag pattern along the recording medium delivery path 110*d*. At least one of the plurality of terminals may have a different length from the other terminals.

The plurality of terminals 125*a* to 125*d* includes the ground terminal 125*a*.

In the case where the connection unit 117 of the board 118 comes into contact with the plurality of terminals 125*a* to 125*d* of the developing cartridge 120, the ground terminal 125*a* of the memory unit 125 may first come into contact with the connection unit 117 of the board 118. Arrangement of the plurality of terminals 125*a* to 125*d* may be changed according to the position of the ground terminal 125*a*.

The plurality of terminals 125*a* to 125*d* of the memory unit 125 may be arranged in parallel to a surface of the board 118.

The plurality of terminals 125*a* to 125*d* of the memory unit 125 may be inclined by a predetermined angle, for example, an angle of 70~110 degrees with respect to the surface of the board 118. The angle range may allow the plurality of terminals 125*a* to 125*d* of the memory unit 125 to come into contact with the connection unit 117 without increasing the physical size of the image forming apparatus 100.

To come into contact with the plurality of terminals arranged by the predetermined inclination angle, the connection unit 117 includes a plurality of connection members 117*a*, 117*b*, 117*c* and 117*d*, (see FIG. 2) which have different vertical linear lengths.

Assuming that the plurality of terminals 125*a* to 125*d* is arranged by the predetermined inclination angle, the plurality of connection members 117*a* to 117*d* may have the corresponding inclination angle to come into contact with the plurality of terminals 125*a* to 125*d*.

The connection member 117*a*, which is arranged to come into contact with the ground terminal 125*a*, may have a greater length than the other connection members 117*b* to 117*d*.

If the plurality of terminals 125*a* to 125*d* of the memory unit 125 comes into contact with the plurality of connection members 117*a* to 117*d* of the connection unit 117, a controller 140 (see FIG. 9) may read the developing cartridge information stored in the memory unit 125 via serial communication.

The developing cartridge information is device information corresponding to the developing cartridge 120 or the image forming apparatus 100.

The developing cartridge information includes at least any one of supplier ID, company name, the serial number of the developing cartridge 120, the date of manufacture, the model name of the image forming apparatus 100, the kind of the developing cartridge 120 (an initially installed developing cartridge, or a regular developing cartridge), the class of the developing cartridge 120 (developer color), the quantity of developer, the dot count of consumed developer, the quantity of developer residue, printed page count, Optical Photo-Conductor (OPC) count, and facsimile sending/receiving count. Addition, omission and change of the developing cartridge information may be possible according to functions or performance of at least one of the developing cartridge 120 and the image forming apparatus 100.

The memory unit 125 may store the developing cartridge information, which may be updated according to the use of the image forming apparatus 100 or the developing cartridge 120.

If a scan unit 170 (see FIG. 9) is used to scan a document, an E-mail transmission unit 171 (see FIG. 9) is used to receive and send an E-mail, or a facsimile unit 172 (see FIG. 9) is used to receive and send an image, the developing cartridge information may be updated although the developing cartridge 120 is not used.

The memory unit 125 may be provided at the single developing cartridge 120. Alternatively, a plurality of memory units may be provided respectively at a plurality of developing cartridges of a specific image forming apparatus (e.g., a color laser printer or color laser multifunctional machine).

If the plurality of memory units is provided, each respective memory unit may store information of a corresponding developing cartridge.

The connection unit 117 serves to connect the board 118 of the image forming apparatus 100 and the memory unit 125 of the developing cartridge 120 to each other. The connection unit 117 will be described hereinafter in detail with reference to FIG. 5.

The board 118 is provided in the lower region of the image forming apparatus 100 below the recording medium delivery path 110*d*.

The board 118 includes at least one of the controller 140 that controls the entire image forming apparatus 100, a Switching Mode Power Supply (SMPS) board 180 (see FIG. 9) that supplies/converts 220V AC power into DC power required by the image forming apparatus 100, and a High Voltage Power Supply (HVPS) 181 (see FIG. 9) that outputs high voltage, such as charging voltage, developing voltage and transfer voltage, using the input DC power.

The connection unit 117 may be connected to the controller 140, an integrated board of the controller 140 and the SMPS board 180, or an integrated board of the controller 140 and the HVPS board 181.

The controller 140 may include a Central Processing Unit (CPU) 141, a Read Only Memory (ROM) 142 in which a control program is stored, and a Random Access Memory (RAM) 143 which serves as an input data memory or operation-related memory. The CPU 141, the ROM 142 and the RAM 143 may be connected to one another via buses. The controller 140 controls the operating unit 160, display unit 161, storage unit 162, image processing unit 163, scan unit 170, communication interface unit 150, developing cartridge 120, and so on.

The controller 140 may control the operating unit 160 to receive user input, the recording medium supply unit 113 to supply recording media into the image forming apparatus 100, and the recording medium discharge unit 116 to discharge the recording media from the image forming apparatus.

The controller 140 may also control at least one motor (not shown) associated with delivery of recording media and operation of the light scanning unit 111, at least one clutch (not shown), or at least one solenoid (not shown). In this way, the controller 140 may monitor and control all operations of the image forming apparatus 100.

FIG. 2 is a perspective view schematically illustrating a state just prior to installing the developing cartridge into the image forming apparatus.

When attempting to open the cover 110*a* of the image forming apparatus 100 and to mount the developing cartridge 120 into the image forming apparatus 100, the developing cartridge 120 slides along the guide 119 provided at a lateral surface of the body 110 by use of at least one protrusion 127*e* protruding respectively from one end surface 127*c* and the other end surface (not shown) of the housing 127.

After the developing cartridge 120 is completely mounted in the image forming apparatus 100, the plurality of terminals 125*a* to 125*d* of the memory unit 125 provided at the rear end of the developing cartridge 120 comes into contact with the connection unit 117 that is located outside of the recording medium delivery path 110*d*.

The guide 119 provided at the body 110 consists of a first path 119*a*, which serves as an admission path and has an inclination angle of 60 degrees or less with respect to the surface of the board 118, a second path 119*b* which has an inclination angle of 60 degrees or more with respect to the surface of the board 118, and a curved portion 119*c* connecting the first path and the second path to each other.

The second path 119*b* having a greater inclination angle than the first path 119*a* causes the developing cartridge 120 to slide due to gravity and thus, be installed into the image forming apparatus 100. The guide 119 guides the developing cartridge 120 to the installation position illustrated in FIG. 4.

A lateral surface 110*b* of the body 110 of the image forming apparatus 100 is provided with a plurality of connection terminals 110*c*, each of which comes into contact with the photoconductive medium 121, the at least one developer delivery member, or the charging unit 122 of the developing cartridge 120.

The photoconductive medium 121, the at least one developer delivery member, or the charging unit 122 of the developing cartridge 120 is operated upon receiving power from the motor (not shown) of the image forming apparatus 100.

Power from the motor (not shown) is transmitted to the string of gears 129 (see FIG. 3) that is exposed through the third opening 127*d* (see FIG. 3) perforated in the housing 127 of the developing cartridge 120.

The housing 127 may include the first opening 127*a* for introduction of the laser beam 111*a*, the second opening 127*b* to expose the photoconductive medium 121, the end surface 127*c* defining a lateral surface of the developing cartridge 120, the third opening 127*d* to expose the string of gears 129 to allow the gears to receive power from the motor (not shown), and the at least one protrusion 127*e* protruding from the end surface 127*c* of the developing cartridge 120 to guide installation/separation of the developing cartridge 120.

The connection unit 117 protrudes upward from the board 118 to face the light scanning unit 111 at a position outside of the recording medium delivery path 110*d*, i.e. outside of the region defined by the width of the largest recording medium that can be utilized by the image forming apparatus 100.

The connection members 117*a* to 117*d* of the upwardly protruding connection unit 117 may be aligned in a line or in a zigzag pattern along the recording medium delivery path 110*d*.

The connection unit 117 is located between the entrance 115*c* of the fusing unit 115 and a vertical line connecting the board 118 and the center of the rotating shaft of the photoconductive medium 121 to each other.

If the developing cartridge 120 is completely installed and the open cover 110*a* of the image forming apparatus 100 is closed, a cover open error message disappears from the display unit 161, and the image forming apparatus 100 is initialized.

The controller 140 reads the developing cartridge information stored in the memory unit 125 by use of the plurality of terminals 125*a* to 125*d* of the memory unit 125 in contact with the plurality of connection members 117*a* to 117*d* of the connection unit 117.

The read developing cartridge information corresponding to the developing cartridge 120 or the image forming apparatus 100 may be utilized for the maintenance or repair of the image forming apparatus 100.

FIG. 3 is a bottom view of the developing cartridge 120.

Referring to FIG. 3, the photoconductive medium 121 is exposed through the second opening 127*b* perforated in the bottom of the developing cartridge 120 that has been mounted in the image forming apparatus 100.

The housing 127 is provided with the first opening 127*a*, the second opening 127*b*, end surface 127*c*, the third opening 127*d* and the at least one protrusion 127*e*.

The plurality of terminals 125*a* to 125*d* of the memory unit 125 are arranged close to the exposed photoconductive medium 121.

The plurality of terminals 125*a* to 125*d* of the memory unit 125 may be arranged outside of the region defined by the width of the largest recording medium that can be utilized by the image forming apparatus 100.

Specifically, the plurality of terminals 125*a* to 125*d* of the memory unit 125 are arranged in the axial direction of the photoconductive medium 121 between the protrusion 127*e* of the end surface 127*c* of the developing cartridge 120 and an end 121*a* of the photoconductive medium 121 exposed through the second opening 127*b*.

Since the exposed photoconductive medium 121 has a greater axial length than the width of the recording medium, the plurality of terminals 125*a* to 125*d* may overlap the end 121*a* of the photoconductive medium 121 exposed through the second opening 127*b*.

The plurality of terminals 125*a* to 125*d* may be arranged in a line or in a zigzag pattern along the end 121*a* of the exposed photoconductive medium 121 toward the fusing unit 115.

The plurality of terminals 125*a* to 125*d* may be arranged in a line or in a zigzag pattern in the axial direction of the exposed photoconductive medium 121.

Each of the plurality of terminals 125*a* to 125*d* has an area sufficient to continuously come into contact with a corresponding one of the plurality of connection members 117*a* to 117*d* of the connection unit 117.

The plurality of terminals 125*a* to 125*d* may be located inward of the free end 128*a* of the handle 128 provided at the developing cartridge 120.

Figure 4:
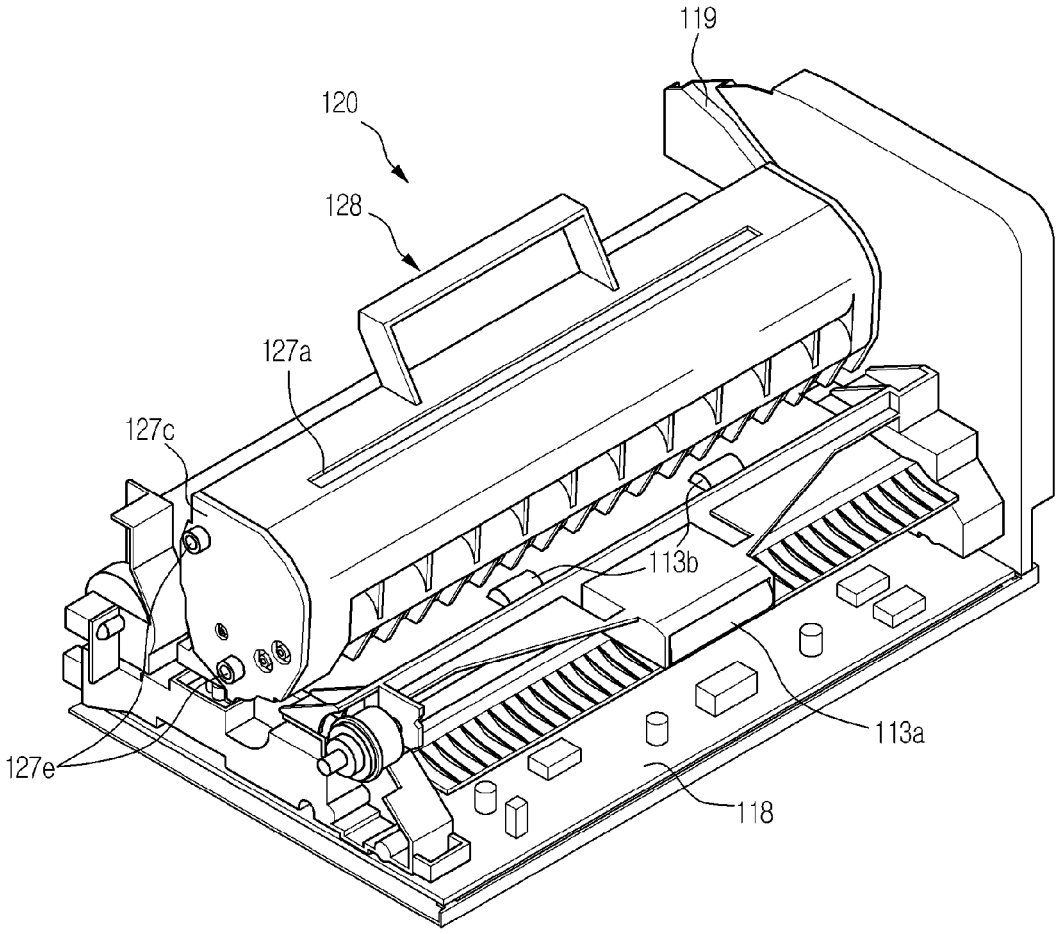
FIG. 4 is a perspective view illustrating the developing cartridge completely installed in the image forming apparatus according to an exemplary embodiment of the present general inventive concept.

FIG. 4 is a perspective view illustrating the developing cartridge 120 completely installed in the installation position in the image forming apparatus.

Referring to FIG. 4, the plurality of terminals of the memory unit 125 of the developing cartridge 120 come into contact with the connection unit 117 of the image forming apparatus 100.

The handle 128 may be fixed to the developing cartridge 120.

Alternatively, the handle 128 may have the fixed one end 128*a* and the other free end 128*b* that is rotatable by a predetermined angle.

The rotation angle is determined to allow the handle 128 to be rotated without coming into contact with the body 110 or the cover 110*a* of the image forming apparatus 100 when the developing cartridge 120 is mounted into the image forming apparatus 100 under the assistance of the guide 119 of the body 110.

Once the developing cartridge 120 is installed in the image forming apparatus 100, the light scanning unit 111 is located above the developing cartridge 120 such that the laser beam 111*a* of the light scanning unit 111 is introduced along the optical path 126 through the first opening 127*a* of the housing 127 of the developing cartridge 120.

Figure 5:
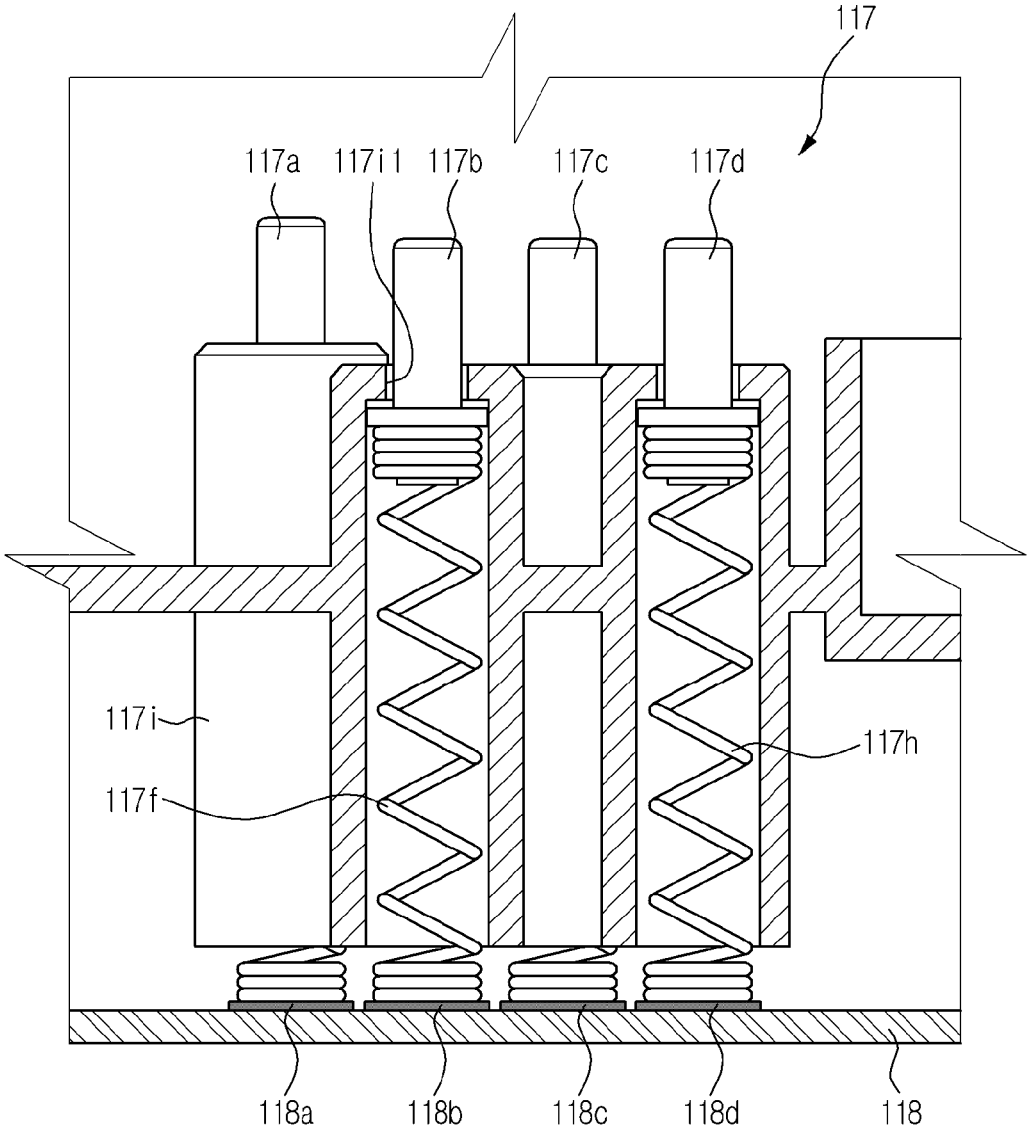
FIG. 5 is a side sectional view illustrating a connection unit of the image forming apparatus and a memory unit of the developing cartridge according to an exemplary embodiment of the present general inventive concept.

FIG. 5 is a side sectional view illustrating the connection unit 117 of the image forming apparatus and the memory unit 125 of the developing cartridge 120.

Referring to FIG. 5, the connection unit 117 includes the plurality of connection members 117*a* to 117*d*, a plurality of support members 117*e*, 117*f*, 117*g* and 117*h*, and a frame 117*i*, and the board 118 includes a plurality of contacts 118*a*, 118*b*, 118*c* and 118*d*.

The plurality of connection members 117*a* to 117*d* of the connection unit 117 come into contact with the plurality of terminals 125*a* to 125*d*. The plurality of support members 117*e* to 117*h* supports the plurality of connection members 117*a* to 117*d* and is connected to the board 118.

The plurality of connection members 117*a* to 117*d* may have a shape suitable to maintain stable contact with the plurality of terminals 125*a* to 125*d* while only slightly interfering with the plurality of terminals 125*a* to 125*d* upon installation/separation of the developing cartridge 120.

The developing cartridge 120 may be installed in the installation position under the assistance of the guide 119 of the body 110 by sliding along the first path 119*a*, having the inclination angle of 60 degrees or less with respect to the surface of the board 118, and the second path 119*b* having the inclination angle of 60 degrees or more with respect to the surface of the board 118. This sliding movement may reduce interference between the plurality of terminals 125*a* to 125*d* and the plurality of connection members 117*a* to 117*d*.

The plurality of contacts 118*a* to 118*d* of the board 118 are connected to the controller 140.

If the plurality of connection members 117*a* to 117*d* come into contact with the plurality of terminals 125*a* to 125*d* of the memory unit 125, the controller 140 of the image forming apparatus 100 may control the memory unit 125 of the developing cartridge 120.

A detailed configuration of the plurality of connection members 117*a* to 117*d* will be described hereinafter with reference to FIG. 6A.

Referring to FIG. 5, the frame 117*i* may be provided around the connection member 117*a* and the support member 117*e*.

At least one connection member 117*a* of the plurality of connection members 117*a* to 117*d* may protrude upward higher than the other connection members 117*b* to 117*d*, and thus, may come into contact with the ground terminal 125*a* of the memory unit 125 earlier than the other connection members 117*b* to 117*d*.

A position of the connection member 117*a* connected to the ground terminal 125*a* may be changed according to a connection structure of the developing cartridge 120 and the image forming apparatus 100.

Figure 6A:
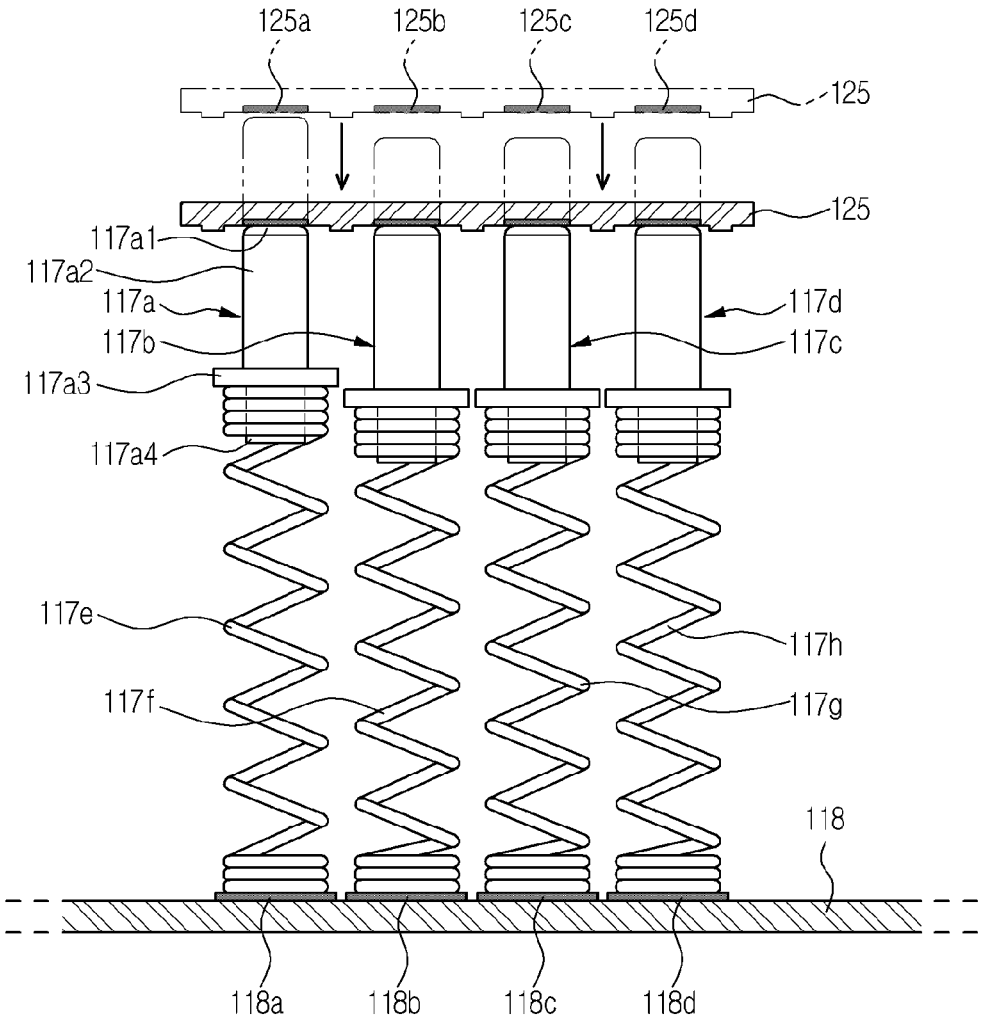
FIGS. 6A and 6B are detailed views illustrating the connection unit of the image forming apparatus according to an exemplary embodiment of the present general inventive concept.
Figure 6B:
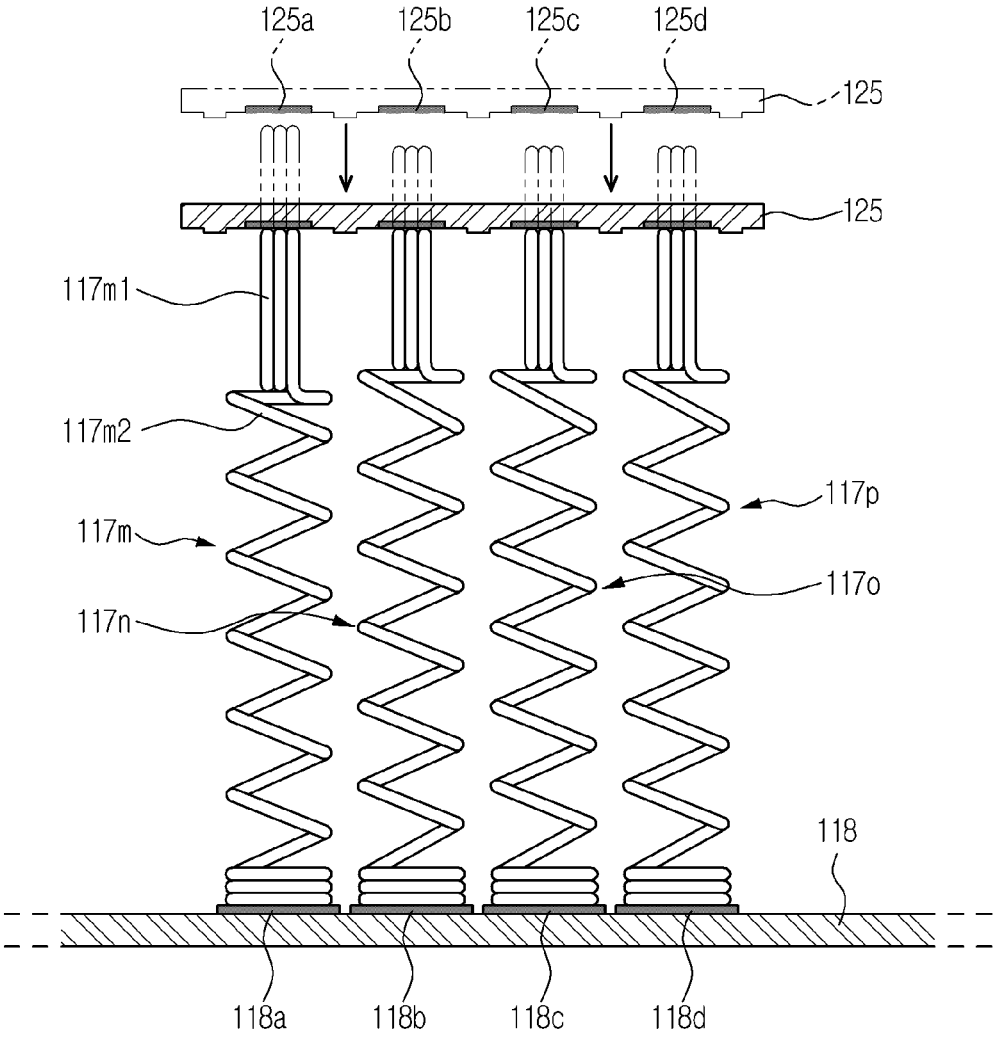

FIGS. 6A and 6B are detailed views illustrating configurations of the connection unit 117 of the image forming apparatus.

FIG. 6A illustrates the connection members 117*a*, 117*b*, 117*c*, 117*d* and the support members 117*e*, 117*f*, 117*g*, 117*h* separately arranged. The connection member 117*a* and the support member 117*e* will be described by way of example.

The connection member 117*a* may include a contact portion 117*a*1, an upper portion 117*a*2, a flange 117*a*3, and a lower portion 117*a*4.

The lower portion 117*a*4 of the connection member 117*a* has a shape corresponding to the cross section of the support member 117*e*. The flange 117*a*3 supports the support member 117*e* connected to the lower portion 117*a*4 of the connection member 117*a*, and has a greater width than the lower portion 117*a*4 of the connection member 117*a*.

The upper portion 117*a*2 of the connection member 117*a* extends upward from the flange 117*a*3 toward the ground terminal 125*a* of the memory unit 125, and has a smaller width than the flange 117*a*3.

An upper end of the connection member 117*a* may be tapered or stepped.

The contact portion 117*a*1 comes into contact with the ground terminal 125*a* of the memory unit 125 and takes the form of a tapered plane portion formed at the top of the upper portion 117*a*2 of the connection member 117*a*.

The contact portion 117*a*1 may also include a stepped plane portion, tapered arcuate portion, or stepped arcuate portion.

The connection member 117*a* may continuously come into contact with the ground terminal 125*a* by the support member 117*e*. To this end, the support member 117*e* may have elasticity to apply constant pressure to the connection member 117*a*.

The connection member 117*a* may be composed of a metal material, such as free-cutting steel (SUM24L) or Steel Wire Rod Cold Heading (SWRCH), and may be subjected to post treatment such as nickel plating.

The SUM24L, SWRCH, or nickel plating is given by way of example, and the material of the connection member 117*a* may be freely selected according to the connection structure and installation positions of the image forming apparatus 100 and the developing cartridge 120.

The supporting member 117*e* may be replaced by a spring or any other equivalent elastic structure that supports the connection member 117*a* to allow the connection member 117*a* to come into contact with the ground terminal 125*a*.

The support member 117*e* may be a bar substantially having no elasticity (not shown). The substantially non-elastic bar (not shown) may be provided with an elastic member (not shown), which connects a part of the bar (not shown) and the board 118 to each other to allow the support member 117*e* to return to an original position thereof when the developing cartridge 120 is separated from the image forming apparatus 100.

The support member 117*e* may be fixed to the contact 118*a* of the board 118 by brazing, or may simply be disposed on the contact of the board 118 without brazing paste.

The frame 117*i* may be provided around the connection member 117*a* and the support member 117*e*.

The frame 117*i* has an opening 117*i*1 having a smaller width than the flange 117*a*3, through which a part of the upper portion 117*a*2 and the contact portion 117*a*1 of the connection member 117*a* protrudes to come into contact with the ground terminal 125*a*.

The opening 117*i*1 of the frame 117*i* has a smaller width than the flange 117*a*3, allowing the flange 117*a*3 to support the support member 117*e*.

The frame 117*i* may have a greater width than the flange 117*a*3 and may extend to the contact 118*a* of the board 118.

Once the developing cartridge 120 is mounted, the plurality of connection members 117*a* to 117*d* come into contact with the plurality of terminals 125*a* to 125*d* of the memory unit 125, thereby being pushed downward.

Referring to FIG. 6A, the clash-dotted line represents the developing cartridge 120 before installation of the memory unit 125, and the solid line represents the developing cartridge 120 after installation of the memory unit 125.

The support member 117*e* may be positioned on the contact 118*a* of the board 118 without brazing or an electrically conductive adhesive used to bond the support member 117*e* to the board 118, owing to the opening 117*i*1 of the frame 117*i* having a smaller width than the flange 117*a*3.

The plurality of support members 117*e* to 117*h* may be fixed to the plurality of contacts 118*a* to 118*d* of the board 118 by use of brazing paste or electrically conductive adhesive used to bond the plurality of support members 117*e* to 117*h* to the board 118.

The connection member 117*a* includes the flange 117*a*3, and a portion of the connection member 117*a* immediately below the flange 117*a*3, i.e. the lower portion 117*a*4 is connected to the support member 117*e* in the form of a spring.

The lower portion 117*a*4 of the connection member 117*a* has a smaller width than a diameter of the spring and thus, may be inserted into the spring. Interference fit or loose fit may be selected according to the diameter of the spring and the width of the lower portion 117*a*4 of the connection member 117*a*.

FIG. 6B illustrates the connection members 117*m*, 117*n*, 117*o* and 117*p* in which the connection members and the support members are integrally formed with each other.

The plurality of integrated connection members 117*m* to 117*p* protrudes upward from the board 118 so as to come into elastic contact with the plurality of terminals 125*a* to 125*d* of the memory unit 125.

The plurality of integrated connection members 117*m* to 117*p* may come into elastic contact with the plurality of terminals 125*a* to 125*d* under the influence of constant pressure due to the opening 117*i*1 of the frame 117*i* and elasticity thereof.

The plurality of integrated connection members 117*m* to 117*p* may be configured such that an upper portion thereof has a greater width than a lower portion thereof.

Hereinafter, a configuration of the plurality of integrated connection members 117*m* to 117*p* will be described based on the integrated connection member 117*m*.

If the width of the opening 117*i*1 of the frame 117*i* is greater than that of the upper portion 117 *m*1 of the integrated connection member 117*m* and is smaller than that of the lower portion 117*m*2 of the integrated connection member 117*m*, the lower portion 117*m*2 of the integrated connection member 117*m* may be positioned on the contact 118*a* of the board 118 without brazing or an electrically conductive adhesive used to bond the integrated connection member 117*m* to the board 118.

The plurality of integrated connection members 117*m* to 117*p* may be fixed to the contact 118*a* of the board 118 by use of brazing or the electrically conductive adhesive.

At least one 117*m* of the plurality of integrated connection members 117*m* to 1170 may protrude upward higher than the other integrated connection members 117*n* to 117*p*, and thus, may come into contact with the ground terminal 125*a* of the memory unit 125 earlier than the other integrated connection members 117*n* to 1170.

A position of the integrated connection member 117*m* connected to the ground terminal 125*a* may be changed according to a connection structure of the developing cartridge 120 and the image forming apparatus 100.

Figure 7:
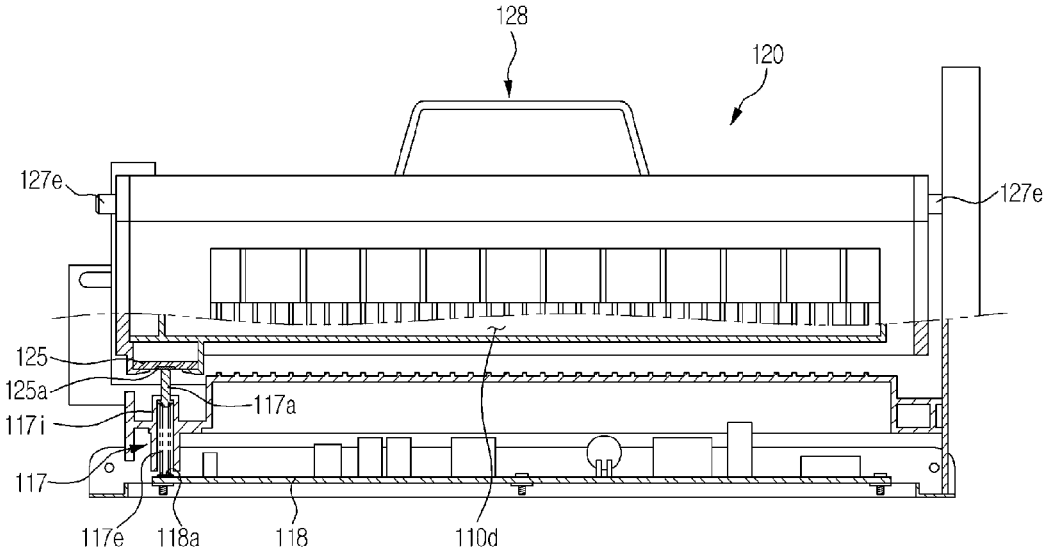
FIG. 7 is a sectional view illustrating an installed state of the connection unit of the image forming apparatus and the memory unit of the developing cartridge according to an exemplary embodiment of the present general inventive concept.

FIG. 7 is a sectional view illustrating a installed state of the connection unit 117 of the image forming apparatus and the memory unit 125 of the developing cartridge 120.

Referring to FIG. 7, there is illustrated a coupling relationship between the board 118, the connection unit 117, and the plurality of terminals 125*a* to 125*d* of the memory unit 125 to form an operative connection with the memory unit 125.

The board 118, the connection unit 117 including the plurality of connection members 117*a* to 117*d* and the plurality of support members 117*e* to 117*h*, and the plurality of terminals 125*a* to 125*d* of the memory unit 125 are connected in series.

The connection unit 117 may be located between the photoconductive medium 121 exposed through the second opening 127*b* of the developing cartridge 120 and the end surface 127*c* of the developing cartridge 120, i.e. between the recording medium delivery path 110*d* and the surface of the developing cartridge 120.

The connection unit 117 may be positioned close to the recording medium delivery path 110*d* without interfering with the delivery of the recording medium.

The board 118 on which a plurality of devices is fixedly mounted is arranged below the recording medium delivery path 110*d*.

When using the board 118, the memory unit 125 of the developing cartridge 120, and the connection unit 117 to connect the board 118 and the memory unit 125 to each other, it may be unnecessary to provide additional wirings and boards corresponding to positions of the memory unit 125 and the board 118.

Further, it may be possible to reduce the height of the image forming apparatus 100 owing to the fact that the memory unit 125 located below the rotating shaft of the developing cartridge 120 comes into contact with the board 118 via the connection unit 117.

That is, if the board 118, the connection unit 117 and the memory unit 125 of the developing cartridge 120 are directly connected to one another, it may be possible to reduce the size (length×width×height) of the image forming apparatus 100.

Figure 8:
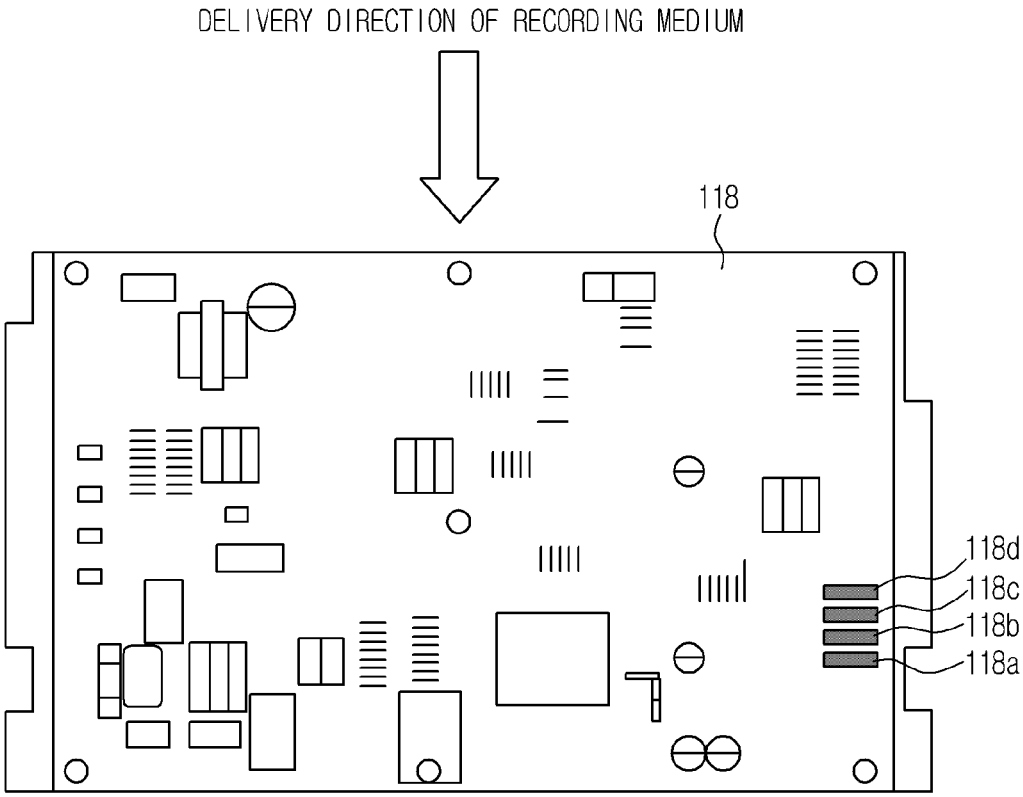
FIG. 8 is plan view illustrating a board of the image forming apparatus according to an exemplary embodiment of the present general inventive concept.

FIG. 8 is plan view illustrating the board 118 of the image forming apparatus.

Referring to FIG. 8, the connection unit 117 is located at the edge of the board 118 including the controller 140 such that the plurality of support members or the plurality of integrated connection members is connected to the plurality of contacts 118*a* to 118*d*.

The plurality of contacts 118*a* to 118*d* of the board 118 are arranged on the edge of the board 118 outside of the region defined by the width of the largest recording medium that can be used by the image forming apparatus 100.

The plurality of contacts 118*a* to 118*d* are connected to the controller 140 via a printed circuit. The controller 140 is connected to the plurality of terminals 125*a* to 125*d* of the memory unit 125 of the developing cartridge 120 by use of the plurality of contacts 118*a* to 118*d* and the connection unit 117, thus confirming installation of the developing cartridge 120 and reading information of the developing cartridge 120 stored in the memory unit 125.

Once the developing cartridge 120 is completely installed and the cover 110*a* of the image forming apparatus 100 is closed, it may be possible to confirm connection of the developing cartridge 120 via communication between the controller 140 and the memory unit 125 of the developing cartridge 120.

The memory unit 125 may receive predetermined instructions from the controller 140 connected thereto. Comparative values corresponding to the received instruction may be previously stored in the memory unit 125.

If the predetermined instruction coincides with the comparative values, the controller 140 may read the developing cartridge information stored in the memory unit 125.

If the predetermined instruction does not coincide with the comparative values, the controller 140 sends a developing cartridge not found error signal to the display unit 161 of the image forming apparatus 100, or a display unit (not shown) of the external device 10 or 20 that is connected to the image forming apparatus 100 via the wired/wireless network 30 or the USB 31.

The board 118 may be an integrated board of the controller 140 and the SMPS board 180, or an integrated board of the controller 140 and the HVPS board 181.

The integrated board 118 may enable a reduction in the number of boards 118 and the size of the image forming apparatus 100.

FIG. 9 is a block diagram illustrating the image forming apparatus according to an aspect of the exemplary embodiment.

Referring to FIG. 9, the controller 140 of the image forming apparatus 100 is connected to the wired/wireless network 30, and also, is connectable to the USB 31.

The controller 140 is connectable to at least one computer 10 via the wired/wireless network 30 or the USB 31, or is connectable to at least one portable appliance 20, such as a cellular phone or a digital camera.

The controller 140 may include the CPU 141, the ROM 142 in which a control program is stored, and the RAM 143 serving as an input data memory or operation-related memory. The CPU 141, the ROM 142 and the RAM 143 may be connected to one another via buses.

The controller 140 may control the operating unit 160, the display unit 161, the storage unit 162, the image processing unit 163, the scan unit 170, the Email transmission unit 171, the facsimile unit 172, the communication interface unit 150, the developing cartridge 120, and so on.

Also, the controller 140 may control the light scanning unit 111, the transfer unit 114, the fusing unit 115, the photoconductive medium 121, the charging unit 122, the developing unit 123, the cleaning unit 124 and the memory unit 125 for image formation.

The controller 140 may control input/output power by use of the SMPS board 180 and the HVPS board 181 to supply power to the respective interior units of the image forming apparatus 100.

The controller 140 may control the memory unit 125, through the connection unit 117, to read or write the developing cartridge information stored in the memory unit 125 of the developing cartridge 120.

Once the developing cartridge 120 is mounted, the controller 140 may determine information about consumables as well as the state of the developing cartridge 120 and the image forming apparatus 100 by reading the developing cartridge information stored in the memory unit 125, and may also perform item authentication.

If an image is completely output in response to an output signal, information corresponding to the image output may be recorded and updated in the memory unit 125.

The controller 140 may control the operating unit 160 to receive user input, the recording medium supply unit 113 to supply recording media into the image forming apparatus 100, and the recording medium discharge unit 116 to discharge the recording media from the image forming apparatus.

Also, the controller 140 may control at least one motor (not shown) associated with delivery of recording media and operation of the light scanning unit 111 and the developing cartridge 120.

The controller 140 may also control at least one clutch (not shown), or at least one solenoid (not shown). That is, the controller 140 may monitor and control all the operations of the image forming apparatus 100.

During operation of the image forming apparatus 100, the storage unit 162 may copy and store the developing cartridge information stored in the memory unit 125 of the developing cartridge 120. The copied information may be utilized as backup developing cartridge information.

The developing cartridge information may also be stored in the RAM 143.

The controller 140 scans a document using the scan unit 170, and inputs an image signal corresponding to the scanned document into the image processing unit 163. The image processing unit 163 processes the image signal according to a scan option corresponding to the user input from the operating unit 160 so as to produce image data.

The controller 140 may output the produced image data on a recording medium, or may transmit the produced image data to an external facsimile (not shown) through Tel-line, or may store the produced image data in a file having a specific extension (e.g., JPEG, BMP, TIFF, or PDF) for transmission over the Internet.

Figure 10:
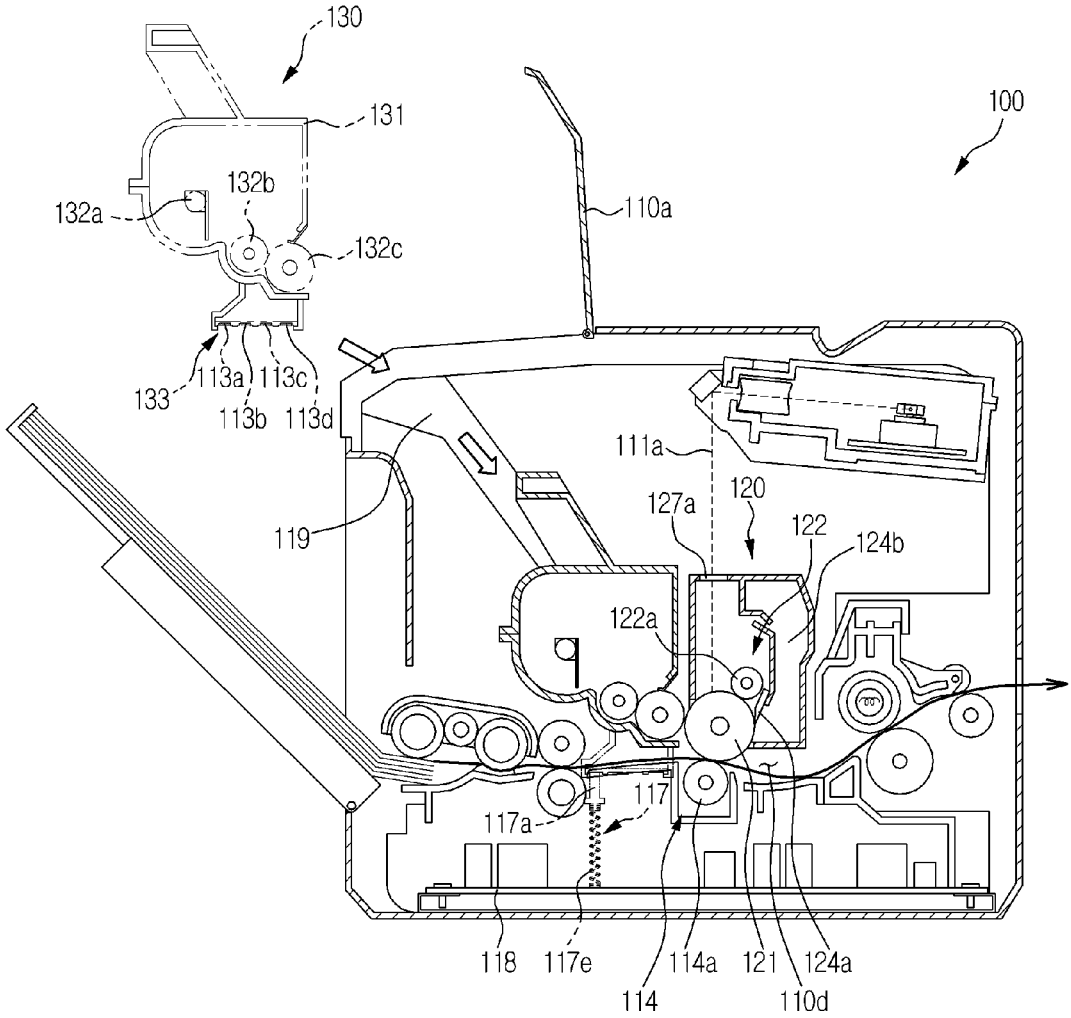
FIG. 10 is a sectional view illustrating an image forming apparatus in which a developing cartridge and a developer cartridge are installed according to an exemplary embodiment of the present general inventive concept.

FIG. 10 is a sectional view illustrating the developing cartridge 120 and a developer cartridge 130 installed in the image forming apparatus.

In FIG. 10, the respective units illustrated in FIG. 1 and the reference numerals thereof are referenced, and the same reference numerals and a description of the Same units are omitted.

The developing cartridge 120 in which the photoconductive medium 121, the charging unit 122, the developer delivery member 123 and the cleaning unit 124 are integrated has been described with reference to FIG. 1.

Referring to FIG. 10 illustrating another exemplary embodiment of the present general inventive concept, an additional developer cartridge 130 may be provided. The developer cartridge 130 may serve to store developer and may be provided with the developer delivery member to deliver the stored developer to the photoconductive medium 121.

The developer cartridge 130 is separable from the developing cartridge 120 including the photoconductive medium 121.

The developer cartridge 130 may include a housing 131 in which developer is stored, the developer delivery member 132 rotatably supported in the housing 131 to deliver the stored developer (e.g., including an agitator 132*a*, a supply roller 132*b* and a developing roller 132*c*), and a memory unit 133 to store developer cartridge information.

The memory unit 133 includes a plurality of terminals 133*a*, 133*b*, 133*c* and 133*d*. The plurality of terminals 133*a* to 133*d* is exposed to the outside of the housing 131 so as to come into contact with the connection unit 117 of the board 118 located below the recording medium delivery path 110*d* when the developer cartridge 130 is mounted into the image forming apparatus 100.

Once the developer cartridge 130 is mounted in the image forming apparatus 100, the plurality of terminals 133*a* to 133*d* of the memory unit 133 may be arranged to face the recording medium delivery path 110*d*.

The developing cartridge 130 may include the photoconductive medium 121, the charging unit 122 and the cleaning unit 124.

When attempting to open the cover 110*a* of the image forming apparatus 100 and to mount the developer cartridge 130 into the image forming apparatus 100, the developer cartridge 130 slides along the guide 119 of the body 110 by use of at least one protrusion (not shown) protruding from either lateral surface (not shown) thereof.

Once the developer cartridge 130 is mounted in the image forming apparatus 100, the plurality of terminals 133*a* to 133*d* conies into contact with the connection unit 117 of the board 118 located below the recording medium delivery path 110*d*.

Specifically, once the developer cartridge 130 is mounted in the image forming apparatus 100, the plurality of terminals 133*a* to 133*d* of the memory unit 133 is arranged to face the recording medium delivery path 110*d*, thus coming into contact with the plurality of connection members 117*a* to 117*d* of the connection unit 117 of the board 118 that is also arranged to face the recording medium delivery path 110*d*.

The developing cartridge 120 has been mounted in the image forming apparatus 100, and the developer cartridge 130 may be coupled to the developing cartridge 120. Alternatively, the developing cartridge 120 and the developer cartridge 130 may first be coupled to each other and then, be mounted in the image forming apparatus 100.

The developer cartridge 130 and the developing cartridge 120 may respectively have fastening structures (not shown) so as to be coupled to each other.

The developer cartridge may include a housing in which developer is stored, at least one of an auger and an agitator to deliver the developer, and a memory unit to store developer cartridge information.

Accordingly, of the developer delivery members usable with the developer cartridge, the supply roller and the developing roller may be provided in the developing cartridge 120.

The developer cartridge 130 has a port (not shown) to discharge the stored developer, and may supply the developer to the developer delivery member of the developing cartridge by use of the auger and the port.

The developer cartridge 130, which is separable from the developing cartridge 120, simplifies maintenance and repair of the image forming apparatus and results in a reduction in maintenance and repair costs.

As is apparent from the above description, the present general inventive concept may provide a developing cartridge 120 including a photoconductive medium 121 and a memory unit 125 having a plurality of terminals 125*a* to 125*d* arranged to face a recording medium delivery path when the developing cartridge 120 is installed in the image forming apparatus.

The present general inventive concept may provide a developer cartridge 120, which includes a housing 127 in which developer is stored and a memory unit 125 having a plurality of terminals 125*a* to 125*d* arranged to face a recording medium delivery path when the developer cartridge 120 is installed in an image forming apparatus.

The present general inventive concept may provide an image forming apparatus in which a developing cartridge 120 is separably installed, the developing cartridge 120 including a photoconductive medium 121 and a memory unit 125 having a plurality of terminals 125*a* to 125*d* to come into contact with a connection unit 117 of a board 118 placed in a lower region of the image forming apparatus.

The present general inventive concept may provide an image forming apparatus in which a developer cartridge 120 is separably installed, the developer cartridge 120 including a housing 127 in which developer is stored and a memory unit 125 having a plurality of terminals 125*a* to 125*d* to come into contact with a connection unit 117 of a board 118 placed in a lower region of the image forming apparatus.

Although a few embodiments of the present invention have been shown and described, it would be appreciated by those skilled in the art that changes may be made in these embodiments without departing from the principles and spirit of the general inventive concept, the scope of which is defined in the claims and their equivalents.

What is claimed is:

1. A developing cartridge separably installed in an image forming apparatus having a recording medium delivery path, the developing cartridge comprising:

a photoconductive medium on which an electrostatic latent image corresponding to an irradiated laser beam is formed;

a charging unit to charge the photoconductive medium;

a developer delivery member to supply developer to the photoconductive medium to enable formation of a visible image corresponding to the electrostatic latent image;

a cleaning unit to remove developer remaining on the photoconductive medium after the visible image formed on the photoconductive medium is transferred to a recording medium; and a memory unit to store developing cartridge information and having a plurality of terminals to come into contact with a connection unit of a board placed in a lower region of the image forming apparatus when the developing cartridge is installed into the image forming apparatus.

2. The developing cartridge according to claim 1, wherein:

the developer delivery member includes at least one rotating shaft; and the memory unit comes into contact with the connection unit below the rotating shaft when the developing cartridge is installed into the image forming apparatus.

3. The developing cartridge according to claim 1, wherein the memory unit is arranged at a rear end of the developing cartridge with respect to an installation direction of the developing cartridge.

4. The developing cartridge according to claim 1, wherein the plurality of terminals of the memory unit are arranged to face the recording medium delivery path when the developing cartridge is installed into the image forming apparatus.

5. The developing cartridge according to claim 4, wherein the memory unit is arranged outside of a region defined by a width of the recording medium that is delivered along the recording medium delivery path.

6. The developing cartridge according to claim 1, further comprising:

a housing to rotatably support the photoconductive medium, wherein the housing includes an opening perforated in an axial direction of the photoconductive medium to allow a partial surface of the photoconductive medium to be exposed to the outside of the housing, and wherein the plurality of terminals of the memory unit are arranged at a lateral side of the opening with respect to an installation direction of the developing cartridge.

7. The developing cartridge according to claim 1, wherein the plurality of terminals are arranged in a line or in a zigzag pattern along the recording medium delivery path.

8. The developing cartridge according to claim 1, wherein at least one of the plurality of terminals has a length different from those of the other terminals.

9. An image forming apparatus to form an image on a recording medium, comprising:

a light scanning unit;

a body having a guide to enable installation of a developing cartridge;

a recording medium delivery unit to deliver the recording medium along a recording medium delivery path defined in the body;

the developing cartridge separably installed in the body using the guide and including:

a photoconductive medium on which an electrostatic latent image corresponding to a laser beam irradiated from the light scanning unit is formed;

a charging unit to charge the photoconductive medium;

a developer delivery member to supply developer to the photoconductive medium to enable formation of a visible image corresponding to the electrostatic latent image;

a cleaning unit to remove developer remaining on the photoconductive medium after the visible image formed on the photoconductive medium is transferred to the recording medium; and a memory unit to store developing cartridge information and having a plurality of terminals facing the recording medium delivery path; and a board including a controller and a connection unit to come into contact with the plurality of terminals of the memory unit, the board being placed in a lower region of the body to allow the connection unit to be located below the plurality of terminals.

10. The image forming apparatus according to claim 9, wherein:

the developer delivery member includes at least one rotating shaft; and the connection unit protrudes upward below the rotating shaft so as to come into contact with the plurality of terminals.

11. The image forming apparatus according to claim 9, wherein the connection unit comes into contact with the plurality of terminals at a position outside of a region defined by a width of the recording medium that is delivered along the recording medium delivery path.

12. The image forming apparatus according to claim 9, wherein the connection unit includes:

connection members protruding upward to come into contact with the plurality of terminals; and support members connected to the board to elastically support the connection members.

13. The image forming apparatus according to claim 9, wherein the connection unit includes connection members connected to the board and protruding upward to come into elastic contact with the plurality of terminals.

14. The image forming apparatus according to claim 12, wherein the connection members have a contact angle of about 70 to 110 degrees with a surface of the terminal.

15. The image forming apparatus according to claim 11, wherein the connection unit is arranged at an edge of the board to come into contact with the plurality of terminals.

16. The image forming apparatus according to claim 12, wherein the connection members are arranged in a line or in a zigzag pattern along the recording medium delivery path.

17. The image forming apparatus according to claim 9, wherein the controller reads the stored developing cartridge information by use of at least one of the plurality of terminals connected to the connection unit upon installation of the developing cartridge.

18. The image forming apparatus according to claim 9, wherein the controller of the board confirms whether or not the developing cartridge is mounted by use of at least one of the plurality of terminals coming into contact with the connection unit of the board when the developing cartridge is mounted into the body.

19. A developer cartridge separably installed in an image forming apparatus having a recording medium delivery path, the developer cartridge comprising:

a housing to store developer, the housing having a sidewall arranged close to the recording medium delivery path when installed into the image forming apparatus;

at least one developer delivery member rotatably supported in the housing to deliver the developer; and a memory unit to store developer cartridge information and having a plurality of terminals exposed to the outside of the housing through the sidewall so as to come into contact with a connection unit of a board placed below the recording medium delivery path when the developer cartridge is installed into the image forming apparatus.

20. The developer cartridge according to claim 19, wherein the plurality of terminals of the memory unit are arranged to face the recording medium delivery path when the developer cartridge is installed into the image forming apparatus.

21. An image forming apparatus to form an image on a recording medium, comprising:

a light scanning unit;

a body having a guide to enable separation/installation of a developer cartridge;

a recording medium delivery unit to deliver the recording medium along a recording medium delivery path defined in the body;

a photoconductive medium on which an electrostatic latent image corresponding to a laser beam irradiated from the light scanning unit is formed;

the developer cartridge separably installed in the body using the guide and including:

a housing to store developer, the housing having a sidewall arranged close to the recording medium delivery path when mounted into the image forming apparatus;

at least one developer delivery member rotatably supported in the housing to deliver the developer to the photoconductive medium; and a memory unit to store developer cartridge information and having a plurality of terminals exposed to the outside of the housing through the sidewall; and a board including a controller and a connection unit to come into contact with the plurality of terminals of the developer cartridge, the board being placed below the recording medium delivery path to allow the connection unit to come into contact with the plurality of terminals from below when the developer cartridge is mounted into the body using the guide.

22. The image forming apparatus according to claim 21, wherein:

the plurality of terminals of the memory unit are arranged to face the recording medium delivery path when the developer cartridge is mounted into the image forming apparatus; and the connection unit comes into contact with the plurality of terminals facing the recording medium delivery path.

23. A developing cartridge to be installed in an image forming apparatus, comprising:

a housing;

a photoconductive medium disposed in the housing to form an image on a recording medium moving along a feeding direction; and a memory unit storing developer cartridge information and disposed on a portion of the housing at a downstream of the feeding direction, wherein the memory unit is disposed to be physically connected to a board, on which a controller to control an operation of the image forming apparatus is provided, when the developing cartridge is installed in the image forming apparatus.

24. The developing cartridge according to claim 23, wherein the photoconductive medium rotates in a rotation direction and the memory unit is disposed on the portion of the housing corresponding to the rotation direction and the feeding direction.

25. The developing cartridge according to claim 23, wherein the housing comprises:

a first portion in which a charging unit is disposed; and a second portion in which a developer delivery member is disposed, wherein the memory unit is disposed on the first portion of the housing.

26. The developing cartridge according to claim 23, wherein the memory unit is disposed on a bottom portion of the housing.

27. The developing cartridge according to claim 23, wherein the memory unit includes a plurality of terminals which form a part of an exterior surface of the developing cartridge.

28. A developing cartridge separably installed in an image forming apparatus having a recording medium delivery path, the developing cartridge comprising:

a photoconductive medium on which an electrostatic latent image corresponding to an irradiated laser beam is formed;

a developer delivery member to supply developer to the photoconductive medium to enable formation of a visible image corresponding to the electrostatic latent image; and a memory unit to store developing cartridge information and having a plurality of terminals to come into contact with a connection unit of a board disposed in a lower region of the image forming apparatus below the recording medium delivery path such that the memory unit is above the recording medium delivery path when the developing cartridge is installed into the image forming apparatus.

29. The developing cartridge according to claim 28, wherein the recording medium delivery path is disposed at a substantially center portion of the image forming apparatus.

* * * * *